US011269277B1

(12) United States Patent
Taki

(10) Patent No.: US 11,269,277 B1
(45) Date of Patent: Mar. 8, 2022

(54) IMAGE FORMING APPARATUS WITH A MOTOR HAVING A FIRST OR A SECOND ROTATION SPEED

(71) Applicant: TOSHIBA TEC KABUSHIKI KAISHA, Tokyo (JP)

(72) Inventor: Hiroyuki Taki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/124,607

(22) Filed: Dec. 17, 2020

(51) Int. Cl.
*G03G 15/00* (2006.01)

(52) U.S. Cl.
CPC ..... *G03G 15/5008* (2013.01)

(58) Field of Classification Search
CPC ..... G03G 15/5008; G03G 15/5029
See application file for complete search history.

(56) References Cited

U.S. PATENT DOCUMENTS

2011/0280627 A1* 11/2011 Matsuda ..... G03G 15/5008 399/167
2016/0085193 A1* 3/2016 Yuasa ..... G03G 15/5008 399/39
2019/0250548 A1* 8/2019 Tomishima ..... G03G 15/5029
2021/0032056 A1* 2/2021 An ..... G03G 15/5008

FOREIGN PATENT DOCUMENTS

JP 2001-209250 8/2001
JP 2006-146068 6/2006
JP 2011-191598 9/2011

* cited by examiner

*Primary Examiner* — Sandra Brase
(74) *Attorney, Agent, or Firm* — Amin, Turocy & Watson, LLP

(57) ABSTRACT

According to an embodiment, an image forming apparatus includes a motor of which driving current value changes according to a load, an image forming unit, a measuring unit, and a setting unit. The measuring unit forms an image on a medium by using a rotation body rotated by a motor. The measuring unit measures the driving current value of the motor. When a rotation speed of the motor is set to a first speed, the setting unit continues to set the first speed if the driving current value measured by the measuring unit falls within a first range. The setting unit sets a second speed lower than the first speed as the rotation speed if the driving current value measured by the measuring unit falls within a second range higher than the first range.

17 Claims, 6 Drawing Sheets

IMAGE FORMING APPARATUS WITH A MOTOR HAVING A FIRST OR A SECOND ROTATION SPEED

FIELD

Embodiments described herein relate generally to image forming apparatuses.

BACKGROUND

For example, an electrophotographic image forming apparatus has a structure in which a photoconductor drum is rotated by a motor. In some cases, in a high load state, a stability of the rotation of the motor is lowered, which may influence image quality. If the high load state continues for a long time, there is a concern that the motor may be broken.

DETAILED DESCRIPTION

An image forming apparatus according to an embodiment includes a motor of which a driving current value changes according to a load, an image forming unit, a measuring unit, and a setting unit. The measuring unit forms an image on a medium by using a rotation body rotated by a motor. The measuring unit measures the driving current value of the motor. When a rotation speed of the motor is set to a first speed, if the driving current value measured by the measuring unit falls within a first range, the setting unit continues to set the first speed. The setting unit sets a second speed lower than the first speed as the rotation speed if the driving current value measured by the measuring unit falls within a second range higher than the first range. In another embodiment, a method involves forming an image on a medium by using a rotation body rotated by a motor having a driving current value that changes according to a load; measuring the driving current value of the motor; and continuously setting a first speed when a rotation speed of the motor is set to the first speed if the driving current value measured falls within a first range, and setting a second speed lower than the first speed as the rotation speed if the driving current value measured falls within a second range higher than the first range.

Hereinafter, embodiments will be described with reference to the drawings. In the following embodiment, a multi-function peripheral (MFP) provided with an image forming apparatus as a printer will be described as an example. The contents of various operations and various processes described hereinafter are examples, and change of the order of some operations and processes, omission of some operations and processes, addition of other operations and processes, or the like is appropriately possible.

First, a configuration of the MFP according to the embodiment will be described.

Figure 1:
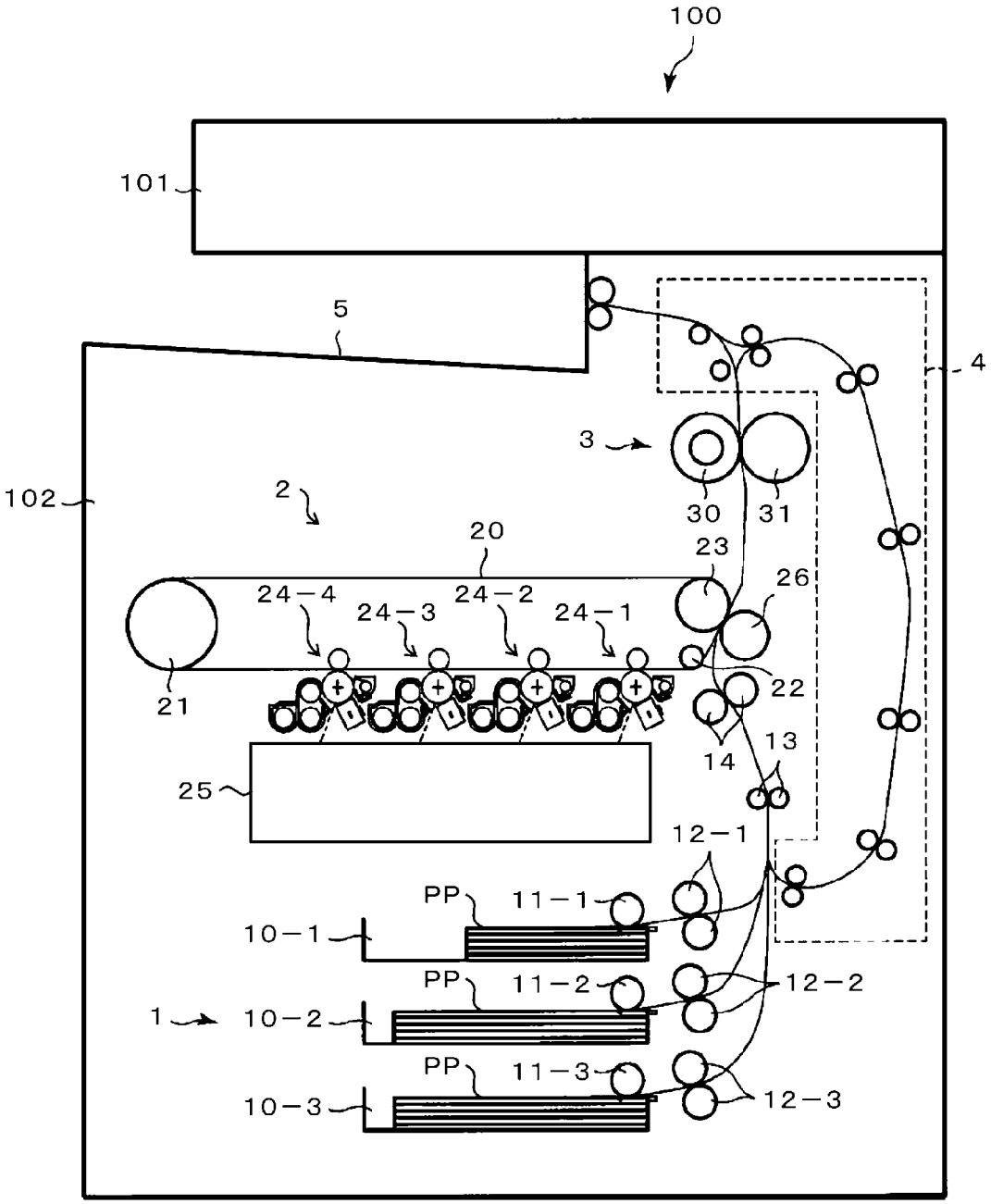
FIG. 1 is a diagram schematically illustrating a mechanical configuration of an MFP according to an embodiment.

FIG. 1 is a diagram schematically illustrating a mechanical configuration of an MFP 100 according to the embodiment.

As illustrated in FIG. 1, the MFP 100 includes a scanner 101 and a printer 102.

The scanner 101 reads an image of a document to generate image data corresponding to the image. The scanner 101 generates image data according to a reflected light image from the reading surface of the document by using an image sensor such as a charge-coupled device (CCD) line sensor. The scanner 101 scans the document placed on a document platen by an image sensor that moves along the document. The scanner 101 also scans the document conveyed by the auto document feeder (ADF) with a fixed image sensor.

The printer 102 forms an image on a medium to be image-formed by an electrophotographic method. The medium is typical print paper such as cut paper. Therefore, hereinafter, it will be described that print paper is used as a medium. However, as the medium, a sheet material made of paper different from the cut paper may be used, or a sheet material made of a material such as resin other than paper may be used. The printer 102 has a color printing function for forming a color image on the print paper and a monochrome printing function for forming a monochrome image on the print paper. The printer 102 forms the color image by overlapping element images by using, for example, three color developers of yellow, magenta, and cyan or four color developers in which black is added to the three color developers. The printer 102 forms a monochrome image by using, for example, a black developer. However, the printer 102 may have only one of a color printing function and a monochrome printing function.

In the configuration example illustrated in FIG. 1, the printer 102 includes a paper feeding unit 1, a print engine 2, a fixing unit 3, an automatic double-sided unit (ADU) 4, and a paper discharge tray 5.

The paper feeding unit 1 includes paper feed cassettes 10-1, 10-2, and 10-3, pickup rollers 11-1, 11-2, and 11-3, conveying rollers 12-1, 12-2, and 12-3, a conveying roller 13, and a registration roller 14.

The paper feed cassettes 10-1 to 10-3 accommodate print paper PP in a state in which sheets of the print paper PP are stacked. The sheets of the print paper PP accommodated in the paper feed cassettes 10-1 to 10-3 may be different types of the print paper PP having different sizes and materials or may be the same type of the print paper PP. The paper feeding unit 1 may also include a manual feed tray additionally.

The pickup rollers 11-1 to 11-3 take out the print paper PP sheet by sheet from each of the paper feed cassettes 10-1 to 10-3. The pickup rollers 11-1 to 11-3 feed the taken-out print paper PP into the conveying rollers 12-1 to 12-3.

The conveying rollers 12-1 to 12-3 feed the print paper PP fed from the pickup rollers 11-1 to 11-3 into the conveying roller 13 via a conveyance path formed by a guide member or the like (not illustrated).

The conveying roller 13 further conveys the print paper PP fed into from any of the conveying rollers 12-1 to 12-3 and feeds the print paper PP into the registration roller 14.

The registration roller 14 corrects the inclination of the print paper PP. The registration roller 14 adjusts the timing of feeding the print paper PP into the print engine 2.

The paper feed cassette, the pickup roller, and the conveying roller are not limited to three sets, and any number of sets may be provided. If the manual feed tray is provided, any set of the paper feed cassette, and the pickup roller and the conveying roller paired to the paper feed cassette may not be provided.

The print engine 2 includes a belt 20, support rollers 21, 22, and 23, image forming units 24-1, 24-2, 24-3, and 24-4, an exposure unit 25, and a transfer roller 26.

The belt 20 has an endless shape and is supported by support rollers 21, 22, and 23 to maintain the state illustrated in FIG. 1. The belt 20 rotates counterclockwise in FIG. 1 as the support roller 21 rotates. The belt 20 temporarily carries an image of a developer to be formed on the print paper PP on an outer surface (hereinafter, referred to as an image-carrying surface). That is, the belt 20 is an example of an image carrier. For the belt 20, for example, semi-conductive polyimide is used in terms of heat resistance and abrasion resistance. The so-called sub-scanning is realized by the movement of the image-carrying surface associated with the rotation of the belt 20, and the movement direction of the image-carrying surface is also called the sub-scanning direction.

Each of the image forming units 24-1 to 24-4 includes a photoconductor drum, a charger, a developing device, a transfer device, and a cleaner and has a well-known structure for performing image formation by an electrophotographic method in cooperation with the exposure unit 25.

Figure 2:
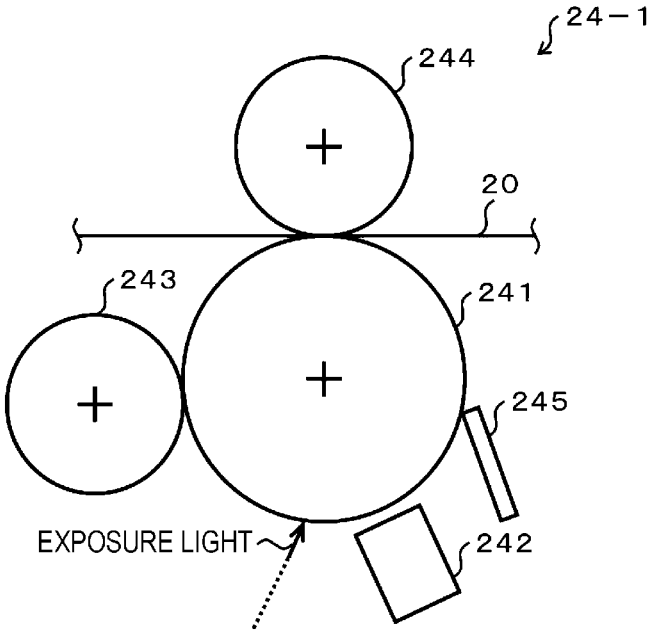
FIG. 2 is a diagram illustrating a portion of a structure of an image forming unit illustrated in FIG. 1.

FIG. 2 is a diagram illustrating a portion of a structure of the image forming units 24-1 to 24-4.

Since the image forming units 24-1 to 24-4 have the same structure, only the structure of the image forming unit 24-1 is illustrated in FIG. 2.

Each of the image forming units 24-1 to 24-4 includes a photoconductor drum 241, a charger 242, a developing sleeve 243, a transfer roller 244, and a cleaning blade 245.

The photoconductor drum 241 is configured by applying a photosensitive conductive material to a curved surface of a base member configured by a conductor such as aluminum formed in a cylindrical shape to form a photosensitive layer. The curved surface of the photoconductor drum 241 is referred to as a photosensitive surface. The photoconductor drum 241 has a columnar shape and is rotatable supported by the frame of the image forming units 24-1 to 24-4 in a posture in which the axial direction is directed in the depth direction in FIG. 2.

The charger 242 uniformly charges the photosensitive surface of the photoconductor drum 241 to a predetermined potential.

The developing sleeve 243 is an element of the developing device. The developing sleeve 243 has a columnar shape and is rotatable supported by a housing of the developing device or the like in a posture in which the axial direction is directed in the depth direction in FIG. 2. A portion of the curved surface of the developing sleeve 243 is located in the accommodation space formed inside the housing, and another portion of the curved surface is located outside the housing. The other portion of the curved surface of the developing sleeve 243 located outside the housing is close to the photosensitive surface of the photoconductor drum 241. The accommodation space is a space for accommodating an unused developer.

The transfer roller 244 is an element of the transfer device. The transfer roller 244 has a columnar shape and is rotatable supported by a housing of the transfer device or the like in a posture in which the axial direction is directed in the depth direction in FIG. 2. The transfer roller 244 faces the photoconductor drum 241 and interposes the belt 20 between the transfer roller 244 and the photosensitive surface of the photoconductor drum 241.

The cleaning blade 245 is an element of the cleaner. The cleaning blade 245 has a plate shape and is attached to the container of the cleaner in a state where the tip is in contact with or close to the photosensitive surface of the photoconductor drum 241. The cleaning blade 245 scrapes off the developer remaining on the surface of the photoconductor drum 241 into the storage container.

The image forming units 24-1 to 24-4 are arranged along the belt 20 in a state in which the axial directions of the photoconductor drums 241 are parallel to each other. The image forming units 24-1 to 24-4 are the same in structure and operation, except that the colors of the developers to be used are different. The image forming unit 24-1 forms an element image by using, for example, a black developer. The image forming unit 24-2 forms an element image by using, for example, a cyan developer. The image forming unit 24-3 forms an element image by using, for example, a magenta developer. The image forming unit 24-4 forms an element image by using, for example, a yellow developer. The image forming units 24-1 to 24-4 overlap the element images of colors on the image-carrying surface of the belt 20. Therefore, the image forming units 24-1 to 24-4 form a color image in which each element image of colors overlap on the image-carrying surface of the belt 20 at the time of passing through the image forming unit 24-1. Although not illustrated, a developer container containing each developer of colors is arranged, for example, in an information space of the belt 20. Thus, each of the image forming units 24-1 to 24-4 is an example of the image forming unit that forms an image by using the photoconductor drum 241 which is an example of the rotation body.

The exposure unit 25 exposes the photoconductor drums 241 of each of the image forming units 24-1 to 24-4 according to the image data representing each element image of colors. As the exposure unit 25, a laser scanner, a light emitting diode (LED) head, or the like is used. If a laser scanner is used, the exposure unit 25 includes, for example, a semiconductor laser element, a polygon mirror, an imaging lens system, and a mirror. Then, the exposure unit 25 allows a laser beam emitted from, for example, the semiconductor laser element according to the image data to be incident on the photoconductor drum 241 of each of the image forming units 24-1 to 24-4 by switching the emission direction by the mirror. A polygon mirror of the exposure unit 25 deflects the photoconductor drum 241 in the axial direction (depth direction in FIG. 1) with the laser beam. The scanning of the laser beam is a so-called main scanning, and the direction thereof is called a main scanning direction.

The transfer roller 26 is arranged in parallel with the support roller 23 and interposes the belt 20 between the transfer roller 26 and the support roller 23. The transfer roller 26 interposes the print paper PP fed out from the registration roller 14 between the transfer roller 26 and the image-carrying surface of the belt 20. Then, the transfer roller 26 transfers the image of the developer formed on the image-carrying surface of the belt 20 to the print paper PP by using electrostatic force. That is, the transfer unit is configured with the support roller 23 and the transfer roller 26. In some cases, the developer may remain on the image-carrying surface of the belt 20, without being completely transferred to the print paper PP. Therefore, the developer adhering to the image-carrying surface of the belt 20 after passing between the support roller 23 and the transfer roller 26 is removed by a cleaner (not illustrated) until the developer arrives at the image forming unit 24-4.

Thus, the print engine 2 forms an image on the print paper PP fed into by the registration roller 14 by an electrophotographic method.

The fixing unit 3 includes a fixing roller 30 and a pressing roller 31.

The fixing roller 30 accommodates a heater inside a hollow roller made of, for example, heat-resistant resin. The heater is, for example, an induction heating (IH) heater, but any other type of heater can be appropriately used. The fixing roller 30 fixes the developer to the print paper PP by melting the developer adhering to the print paper PP fed out from the print engine 2.

The pressing roller 31 is provided in parallel with the fixing roller 30 and in a state of being pressed against the fixing roller 30. The pressing roller 31 interposes the print paper PP fed out from the print engine 2 between the pressing roller 31 and the fixing roller 30 and presses the print paper PP against the fixing roller 30.

The ADU 4 includes a plurality of rollers and selectively performs the following two operations. In a first operation, the print paper PP passing through the fixing unit 3 is fed out toward the paper discharge tray 5 as it is. The first operation is performed when single-sided printing or double-sided printing is completed. In a second operation, the print paper PP passing through the fixing unit 3 is once conveyed to the side of the paper discharge tray 5, then switched back and fed into the print engine 2. The second operation is performed when the image formation on only one side in the double-sided printing is completed.

The paper discharge tray 5 receives the print paper PP on which an image is formed and ejected.

Figure 3:
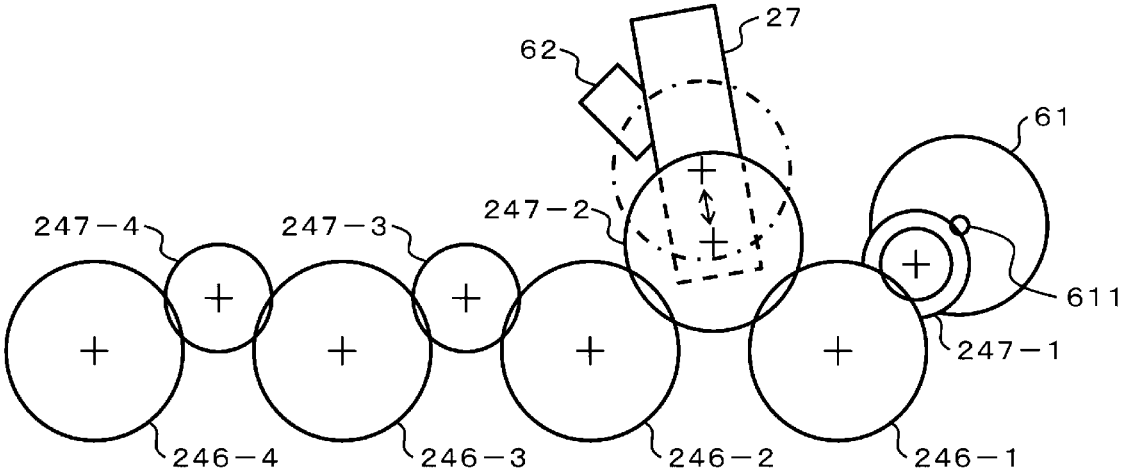
FIG. 3 is a diagram illustrating a portion of the structure of the image forming unit illustrated in FIG. 1.

FIG. 3 is a diagram illustrating a portion of structure of the image forming units 24-1 to 24-4.

Each of the image forming units 24-1 to 24-4 includes one corresponding gear among gears 246-1, 246-2, 246-3, and 246-4. Each of the image forming units 24-1 to 24-4 includes one corresponding gear among gears 247-1, 247-2, 247-3, and 247-4. In FIG. 3, the tooth tip circle of each gear is illustrated.

The gears 246-1 to 246-4 have a disk shape with teeth formed on the outer peripheral surface, and each of the gears can rotate in the clockwise direction and the counterclockwise direction in FIG. 3. The rotation shaft of one photoconductor drum among the photoconductor drums 241 provided in the image forming units 24-1 to 24-4 is coupled with the rotation shaft of each of the gears 246-1 to 246-4. That is, the gears 246-1 to 246-4 are aligned along the arrangement direction of the image forming units 24-1 to 24-4 at the same intervals as the photoconductor drums 241 provided in the image forming units 24-1 to 24-4, respectively.

The gears 247-1 to 247-4 have a disk shape with teeth formed on the outer peripheral surface, and each of the gears can rotate in the clockwise direction and the counterclockwise direction in FIG. 3.

The gear 247-1 is a two-stage gear, and the small-diameter gear is meshed with the gear 246-1. The large-diameter gear of the gear 246-1 is meshed with a gear 611 attached to the rotation shaft of a drum motor 61. That is, the gear 247-1 takes the rotational force of the drum motor 61 into the image forming unit 24-1.

When the gear 247-2 is in the meshed state illustrated by the solid line in FIG. 3, the gear 247-2 is meshed with the gear 246-1 and the gear 246-2. That is, when the gear 247-2 is in the meshed state, the gear 247-2 takes the rotational force of the gear 246-1 into the image forming unit 24-2. The rotation shaft of the gear 247-2 is attached to the moving mechanism 27. The moving mechanism 27 reciprocates the gear 246-2 between the meshed state and the separated state indicated by a one-dot dashed line by the power generated by a switch motor 62. The gear 247-2 is not meshed with any one of the gear 246-1 and the gear 246-2 in the separated state. That is, when the gear 247-2 is in the separated state, the gear 247-2 does not take the rotational force of the gear 246-1 into the image forming unit 24-2.

The gear 247-3 is meshed with each of the gear 246-2 and the gear 246-3. That is, the gear 247-3 takes the rotational force of the gear 246-2 into the image forming unit 24-3.

The gear 247-4 is meshed with each of the gear 246-3 and the gear 246-4. That is, the gear 247-4 takes the rotational force of the gear 246-3 into the image forming unit 24-4.

As the gears 246-1 to 246-4, the small diameter gear of the gear 247-1, and the gears 247-2 to 247-4, for example, helical gears are used.

As the drum motor 61, for example, a DC brushless motor is used. The drum motor 61 rotates constantly at a rotation speed set by a printer controller 81 under the control of a motor controller 87.

Figure 4:
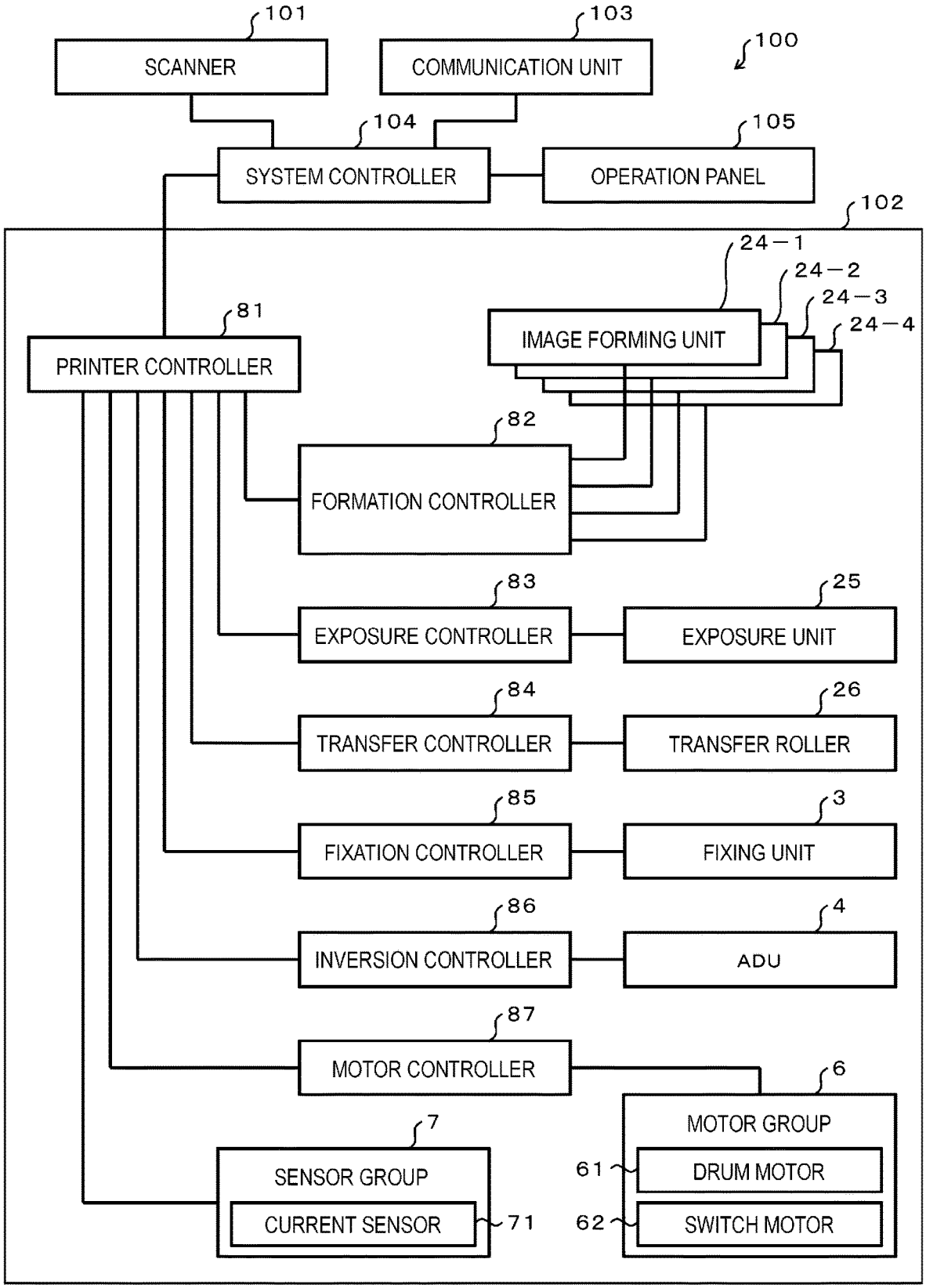
FIG. 4 is a block diagram schematically illustrating a configuration related to control of the MFP illustrated in FIG. 1.

FIG. 4 is a block diagram schematically illustrating a configuration related to control of the MFP 100. In FIG. 4, the same elements illustrated in FIG. 1 and FIG. 3 are denoted by the same reference numerals, and detailed description thereof will be omitted.

The MFP 100 includes a communication unit 103, a system controller 104, and an operation panel 105 in addition to the scanner 101 and the printer 102.

The communication unit 103 performs a process for communicating with an information terminal such as a computer device and an image terminal such as a facsimile machine via a communication network such as a local area network (LAN) and a public communication network.

The system controller 104 collectively controls each unit constituting the MFP 100 in order to realize the intended operation as the MFP 100. The intended operation of the MFP 100 is, for example, an operation for realizing various functions realized by a pre-existing MFP.

The operation panel 105 includes an input device and a display device. An instruction by an operator by the input device is input to the operation panel 105. The operation panel 105 displays various types of information to be notified to the operator by a display device. As the operation panel 105, for example, a touch panel can be used.

The above-mentioned fixing unit 3, ADU 4, image forming units 24-1 to 24-4, exposure unit 25, and transfer roller 26 included in the printer 102 are elements to be controlled. The printer 102 further includes a motor group 6 in the elements to be controlled. The motor group 6 includes a plurality of motors for rotating the pickup rollers 11-1 to 11-3, the conveying rollers 12-1 to 12-3, the conveying roller 13, the registration roller 14, the support rollers 21, the transfer rollers 26, the fixing rollers 30, the rollers included in the ADU 4, and the like. The motor group 6 includes the drum motor 61 and the switch motor 62.

The printer 102 further includes a sensor group 7, the printer controller 81, a formation controller 82, an exposure controller 83, a transfer controller 84, a fixation controller 85, an inversion controller 86, and the motor controller 87.

The sensor group 7 includes various sensors for monitoring the operating state of the apparatus. The sensor group 7 includes a current sensor 71. The current sensor 71 measures the driving current value of the drum motor 61. The current sensor 71 is an example of a measuring unit.

Under the control of the system controller 104, the printer controller 81 collectively controls each unit constituting the printer 102 in order to realize the intended operation as the printer 102.

The formation controller 82, the exposure controller 83, the transfer controller 84, the fixation controller 85, the inversion controller 86, and the motor controller 87 all operate under the control of the printer controller 81 and control the operations of the image forming units 24-1 to 24-4, the exposure unit 25, the transfer roller 26, the ADU 4, and the motor group 6, respectively.

Figure 5:
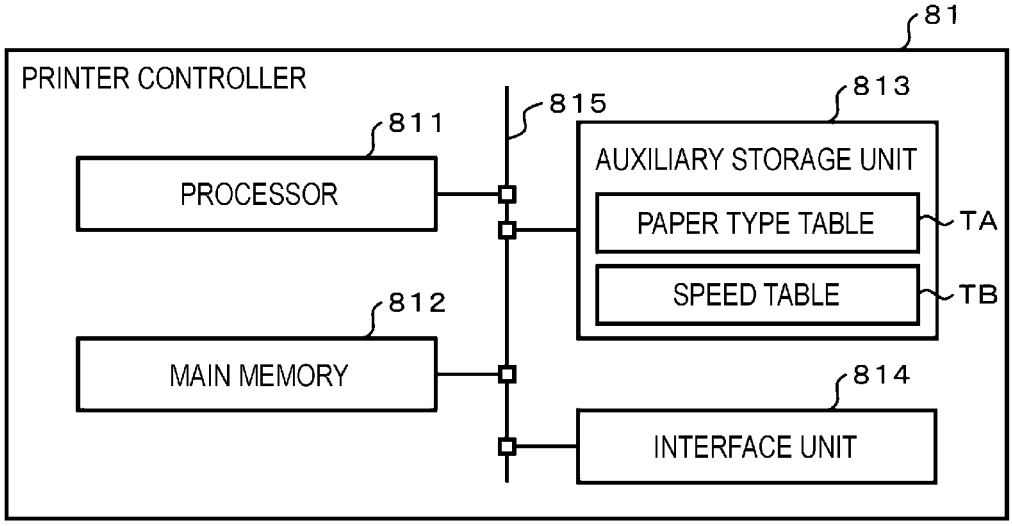
FIG. 5 is a block diagram illustrating a main circuit configuration of a printer controller illustrated in FIG. 4.

FIG. 5 is a block diagram illustrating a main circuit configuration of the printer controller 81.

The printer controller 81 includes a processor 811, a main memory 812, an auxiliary storage unit 813, an interface unit 814, and a transmission line 815.

A computer that performs information processing for the above control is configured by connecting the processor 811, the main memory 812, and the auxiliary storage unit 813 by the transmission line 815.

The processor 811 corresponds to a central portion of the computer. The processor 811 executes information processing described later according to an information processing program such as an operating system, middleware, and an application program.

The main memory 812 corresponds to the main memory portion of the computer. The main memory 812 includes a non-volatile memory area and a volatile memory area. The main memory 812 stores the information processing program in the non-volatile memory area. In some cases, the main memory 812 may store data necessary for the processor 811 to execute each process for controlling each unit in a non-volatile or volatile memory area. The main memory 812 uses the volatile memory area as a work area where data is appropriately rewritten by the processor 811.

The auxiliary storage unit 813 corresponds to an auxiliary storage portion of the computer. As the auxiliary storage unit 813, well-known storage devices such as an electric erasable programmable read-only memory (EEPROM), a hard disk drive (HDD), and a solid state drive (SSD) can be used alone or in combination of two or more. The auxiliary storage unit 813 stores data used by the processor 811 to perform various processes and data generated by processes of the processor 811. The auxiliary storage unit 813 stores the information processing program.

The interface unit 814 performs well-known processes for exchanging data among the sensor group 7, the printer controller 81, the formation controller 82, the exposure controller 83, the transfer controller 84, the fixation controller 85, the inversion controller 86, and the motor controller 87. As the interface unit 814, well-known interface devices or communication devices can be used alone or in combination of two or more.

The transmission line 815 includes an address bus, a data bus, a control signal line, and the like and transmits data and control signals transmitted and received between the connected units.

A portion of the storage area of the auxiliary storage unit 813 is used as a paper type table TA and a speed table TB. The paper type table TA is a data table that describes the types (hereinafter, referred to as paper types) of print paper PP set in the paper feed cassettes 10-1 to 10-3. The speed table TB is a data table that describes conveying speeds of the paper according to the paper types of the print paper PP used for the image formation.

Figure 6:
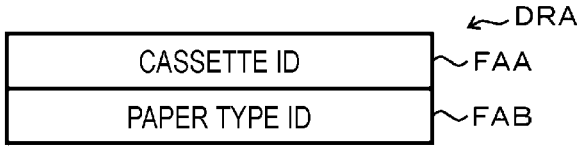
FIG. 6 is a diagram schematically illustrating a structure of data record included in a paper type table illustrated in FIG. 5.

FIG. 6 is a diagram schematically illustrating a structure of the data record DRA included in the paper type table TA.

The paper type table TA is a set of data records DRA associated with the respective paper feed cassettes 10-1 to 10-3. That is, in the embodiment, the paper type table TA includes three data records DRA.

The data record DRA includes fields FAA and FAB. A cassette ID as an identifier for identifying the associated paper feed cassette among the paper feed cassettes 10-1 to 10-3 is set in the field FAA. The cassette ID may be appropriately determined for each of the paper feed cassettes 10-1 to 10-3, for example, by the designer or administrator of the MFP 100. A paper type ID as an identifier for identifying the paper type of the print paper PP set in the associated paper feed cassette among the paper feed cassettes 10-1 to 10-3 is set in the field FAB. In the embodiment, the paper types are classified into two types according to the difference in thickness. Hereinafter, each of the two types of paper will be referred to as thin paper and thick paper. The paper type ID may be appropriately determined by, for example, the designer of the MFP 100. The paper types may be distinguished by other conditions such as material or surface smoothness or may be distinguished by a combination of a plurality of such conditions. The number of paper types may be three or more.

The administrator of the MFP 100 designates one paper feed cassette among the paper feed cassettes 10-1 to 10-3 by a predetermined operation on the operation panel 105 and designates whether thin paper or thick paper is set in the paper feed cassette. For example, in response to the designation, the processor 811 sets the paper type ID of the designated paper type in the field FAB of the data record DRA in which the cassette ID of the designated paper feed cassette is set in the field FAA.

Figure 7:
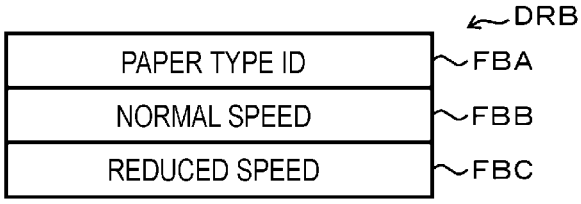
FIG. 7 is a diagram schematically illustrating a structure of data record included in a speed table illustrated in FIG. 5.

FIG. 7 is a diagram schematically illustrating a structure of the data record DRB included in the speed table TB.

The speed table TB is a set of data records DRB associated with the respective paper types that can be set in the paper feed cassettes 10-1 to 10-3. That is, in the embodiment, the speed table TB includes two data records DRB.

The data record DRB includes fields FBA, FBB, and FBC. The paper type ID of the associated paper type is set in the field FBA. A conveying speed during a normal time for the print paper PP of the associated paper type is set in the field FBB. A conveying speed during a reduction time at the time of using the print paper PP of the associated paper type is set in the field FBC. The conveying speed during the normal time and the conveying speed during the reduction time may be defined as appropriate values by the designer of the MFP 100 or the like based on an experiment, a simulation, an empirical rule, or the like for the image formation with the required quality.

Next, operations of the MFP 100 configured as described above will be described. In the following, the operations different from the operations of another existing MFP will be mainly described, and the description of other operations will be omitted.

In the printer controller 81, the processor 811 executes the control process for the image formation according to the information processing program when the execution of a job of the image formation is commanded by the system controller 104.

Figure 8:
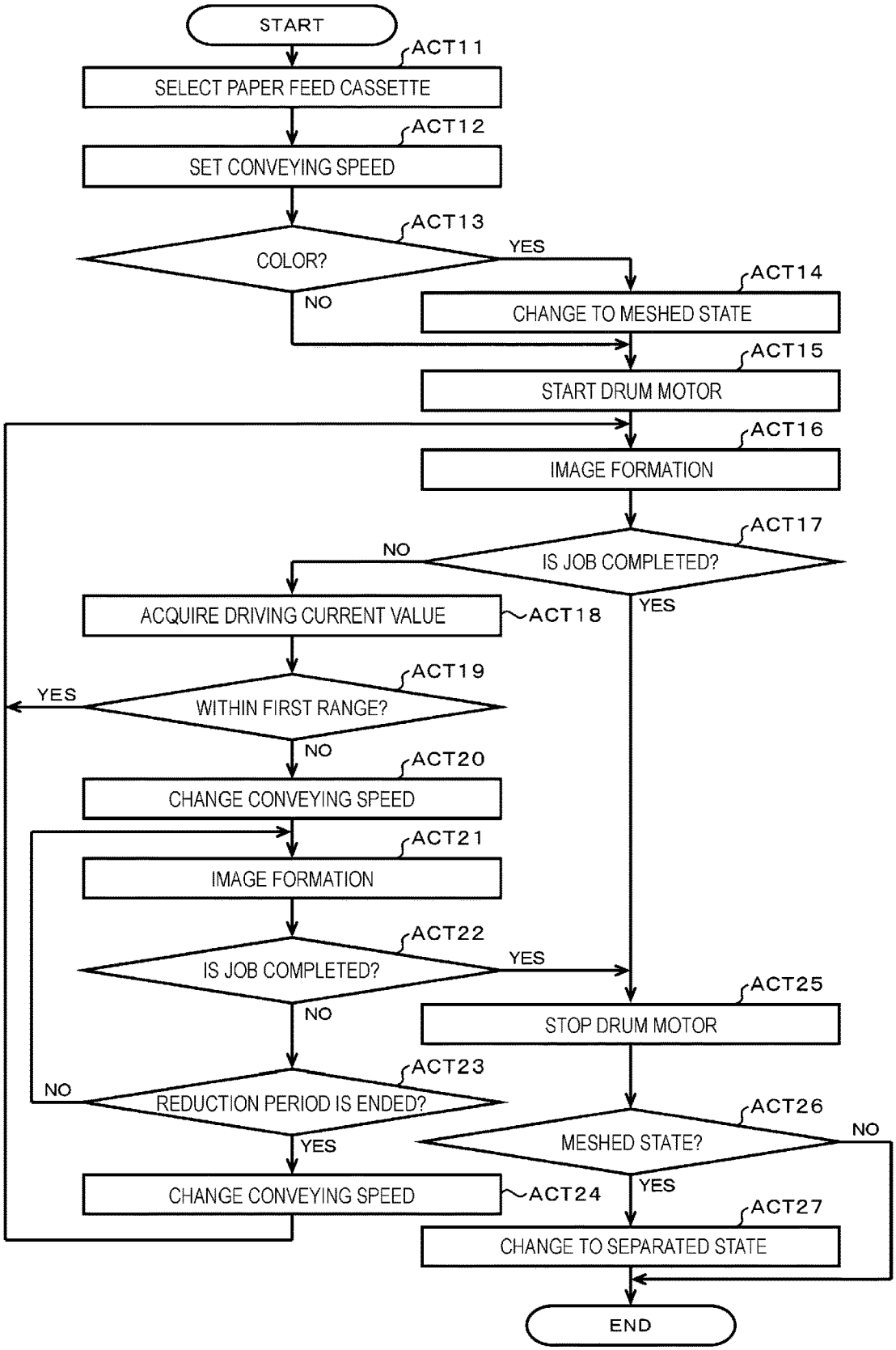
FIG. 8 is a flowchart of a control process by a processor illustrated in FIG. 5.

FIG. 8 is a flowchart of the control process.

In ACT 11, the processor 811 selects one of the paper feed cassettes 10-1 to 10-3. The processor 811 selects a paper feed cassette, for example, designated by the operator by an operation on the operation panel 105. Alternatively, the processor 811 selects one of the paper feed cassettes 10-1 to 10-3, for example, according to predetermined conditions. The processing herein may be the same as the processing, for example, in another existing MFP. Hereinafter, the paper feed cassettes 10-1 to 10-3 selected herein will be referred to as "cassettes to be used".

In ACT 12, the processor 811 sets the conveying speed of the print paper PP. For example, the processor 811 searches the paper type table TA for the data record DRA in which the cassette ID of the cassette to be used selected in ACT 11 is set in the field FAA. Next, the processor 811 searches the speed table TB for the data record DRB in which the paper type ID set in the field FAB of the corresponding data record DRA is set in the field FBA. Then, the processor 811 sets the normal speed set in the field FBB of the corresponding data record DRB as the conveying speed of the print paper PP. That is, if the print paper PP set in the cassette to be used is thin paper, the processor 811 sets the conveying speed during the normal time when the thin paper is used. If the print paper PP set in the cassette to be used is thick paper, the processor 811 sets the conveying speed during the normal time when the thick paper is used. The processor 811 notifies the formation controller 82, the exposure controller 83, the inversion controller 86, and the motor controller 87 of the set conveying speed. The process of the processor 811 here includes a process of determining whether the type of the print paper PP as a medium for forming an image is thin paper or thick paper. Thus, the computer including the processor 811 as a central portion functions as a determining unit that performs such a determination by the processor 811 executing information processing based on the information processing program.

In ACT 13, the processor 811 checks whether the image to be formed is in color. The processor 811 determines YES if the image is in color, and proceeds to ACT 14.

In ACT 14, the processor 811 changes the gear 247-2 to the meshed state. For example, the processor 811 operates the switch motor 62 to move the gear 247-2 to the position in the meshed state illustrated by the solid line in FIG. 3 by the moving mechanism 27. Then, for example, the processor 811 stops the switch motor 62 in response to the detection that the gear 247-2 is at the position in the meshed state by the sensor included in the sensor group 7 and, after that, proceeds to ACT 15.

If the image to be formed is not in color, the processor 811 determines NO in ACT 13, by-passes ACT 14, and proceeds to ACT 15. Here, the gear 247-2 maintains the separated state.

In ACT 15, the processor 811 starts the drum motor 61. For example, the processor 811 instructs the motor controller 87 to start the drum motor 61. In response to the instruction, the motor controller 87 sets the drum motor 61 at a rotation speed uniquely determined according to the conveying speed notified in advance from the processor 811 and, after that, allows the drum motor 61 to be in the rotating state. The rotation speed according to the conveying speed during the normal time when the paper type is thin paper is an example of the first speed. The rotation speed according to the conveying speed during the normal time when the paper type is thick paper is an example of the third speed. Here, the processor 811 may also start motors other than the drum motor 61 included in the motor group 6.

The rotational force generated by the drum motor 61 is transmitted to the gear 246-1 by the gear 611 and the gear 247-1, and the gear 246-1 starts rotating. If the gear 247-2 is in the meshed state, the rotational force of the gear 246-1 is transmitted to the gear 246-2 by the gear 247-2, and the gear 246-2 starts rotating. The rotational force of the gear 246-2 is transmitted to the gear 246-3 by the gear 247-3, and the gear 246-3 starts rotating. The rotational force of the gear 246-3 is transmitted to the gear 246-4 by the gear 247-4, and the gear 246-4 starts rotating. Thus, if the gear 247-2 is in the meshed state, all of the gears 246-1 to 246-4 start rotating, and the photoconductor drum 241 of each of the image forming units 24-1 to 24-4 starts rotating. However, if the gear 247-2 is in the separated state, the rotational force of the gear 246-1 is not transmitted to the gear 246-2, and thus, the gears 246-2 to 246-4 do not rotate. Thus, if the gear 247-2 is in the separated state, only the gear 246-1 among the gears 246-1 to 246-4 starts rotating, and the photoconductor drum 241 of the image forming unit 24-1 starts rotating.

In ACT 16, the processor 811 performs image formation on one sheet of print paper PP. The processor 811 performs the image formation by the electrophotographic method in a well-known manner by allowing each unit of the printer 102 to perform well-known operations for the image formation. Then, the processor 811 proceeds to ACT 17 when the image formation is completed. The formation controller 82, the exposure controller 83, the inversion controller 86, and the motor controller 87 control each unit to be controlled to perform various operations at timings according to the conveying speed notified in advance from the processor 811.

In ACT 17, the processor 811 checks whether the job being executed is completed. For example, when formation of all the images targeted by the job being executed is completed, the processor 811 determines that the job is completed. However, if the completion of the job cannot be checked as such, the processor 811 determines NO and proceeds to ACT 18.

In ACT 18, the processor 811 acquires the driving current value detected by the current sensor 71.

In ACT 19, the processor 811 checks whether the driving current value acquired in ACT 18 falls within a predetermined first range. The first range may be appropriately defined by, for example, the designer of the MFP 100 based on an experiment, a simulation, an empirical rule, or the like.

On the other hand, the drum motor 61 has a function of maintaining a set rotation speed, and thus, the driving current value fluctuates as the load fluctuates. Then, when the driving current value of the drum motor 61 rises to a certain extent, there is a concern that the drum motor 61 may not be able to maintain the rotation speed. Then, if the rotation speed of the drum motor 61 is not stable, there is a concern that the quality of the formed image may be adversely influenced. Therefore, the designer of the MFP 100 or the like defines the first range as the range of the driving current value at which the drum motor 61 can maintain the set rotation speed. It is assumed that the first range is, for example, a range equal to or less than a rated current value of the drum motor 61.

If it is checked that the driving current value falls within the first range, the processor 811 determines YES in ACT 19 and repeats ACT 16 and subsequent processes. That is, the next image formation is performed without changing the rotation speed of the drum motor 61.

The photoconductor drums 241 provided in each of the image forming units 24-1 to 24-4 are supported to be capable of being rotated, for example, by allowing the cylindrical shaft member provided in the photoconductor drums 241 to be inserted into holes formed in the frame. Then, each photoconductor drum 241 rotates as the gears 246-1 to 246-4 rotate. Since the gears 246-1 to 246-4 are meshed with other gears as illustrated in FIG. 3, the gears are subjected to a pressing force in the direction intersecting the rotation shaft. The pressing force acts as a force for pressing the shaft member provided on the photoconductor drum 241 against the hole. The force may fluctuate due to various factors, which results in fluctuation in the load of the drum motor 61. Since the shaft member is pressed against the hole, friction is generated between the shaft member and the frame as the photoconductor drums 241 rotate, and thus, heat is generated. In some cases, when the shaft member and the frame expand due to the heat, the friction between the shaft member and the frame may further increase, and the load of the drum motor 61 may further fluctuate. During the time of forming a monochrome image, since the rotational force of the drum motor 61 is not transmitted to the gears 246-2 to 246-4 and the gears 247-2 to 247-4, the load on the drum motor 61 is unlikely to be excessive. However, during the time of forming a color image, since the rotational force of the drum motor 61 is transmitted to the gears 246-2 to 246-4 and the gears 247-2 to 247-4 to be used for rotating the four photoconductor drums 241 and to allow the increase in friction due to the thermal expansion described above to occur in each of the four photoconductor drums 241, there is a concern that the load on the drum motor 61 may increase significantly. However, in some cases, the friction due to the thermal expansion described above may fluctuate not only depending on whether the gear 247-2 is in the meshed state or the separated state but also depending on various other factors. In some cases, when the processor 811 repeats the loop of ACT 16 to ACT 19 to form a plurality of images, the load on the drum motor 61 is excessive, and the driving current value may deviate from the first range. Then, the processor 811 determines NO in ACT 19 and proceeds to ACT 20.

In ACT 20, the processor 811 changes the conveying speed of the print paper PP. For example, the processor 811 searches the paper type table TA for the data record DRA in which the cassette ID of the cassette to be used selected in ACT 11 is set in the field FAA. Next, the processor 811 searches the speed table TB for the data record DRB in which the paper type ID set in the field FAB of the corresponding data record DRA is set in the field FBA. Then, the processor 811 sets the reduced speed set in the field FBC of the corresponding data record DRB as the conveying speed of the print paper PP. That is, if the print paper PP set in the cassette to be used is thin paper, the processor 811 sets the conveying speed during the reduction time when the thin paper is used. If the print paper PP set in the cassette to be used is thick paper, the processor 811 sets the conveying speed during the reduction time when the thick paper is used. The processor 811 notifies the formation controller 82, the exposure controller 83, the inversion controller 86, and the motor controller 87 of the set conveying speed.

In response to the notification, the motor controller 87 sets the drum motor 61 to a rotation speed specified according to the notified conveying speed. Therefore, the rotation speed of the drum motor 61 is reduced to a rotation speed corresponding to the reduced speed. By reducing the rotation speed of the drum motor 61 as such, the above-mentioned heat generation is reduced to prompt heat dissipation, therefore reducing the load of the drum motor 61. The rotation speed according to the conveying speed during the reduction time when the paper type is thin paper is an example of the second speed. The rotation speed according to the conveying speed during the reduction time when the paper type is thick paper is an example of a fourth speed.

In general, the conveying speed appropriate for thick paper is lower than the conveying speed appropriate for thin paper. That is, as an example, if the normal conveying speed during the normal time for thin paper is VAA and the conveying speed during the normal time for thick paper is VBA, the conveying speeds VAA and VBA are set so that, for example, VAA>VBA. If the conveying speeds during the reduction time for thin paper and thick paper are expressed as VAB and VBB, the relationships of VAA>VAB and VBA>VBB are naturally satisfied.

The conveying speed VAB during the reduction time for thin paper is closer to the conveying speed VBA during the normal time for thick paper than the conveying speed VAA during the normal time. The conveying speeds VAB and VBB during the reduction time may be set to speeds that prompt heat dissipation as described above, and in many cases, the difference between VAB and VBB may be smaller than the difference between VAA and VBA. Therefore, as an example, it is assumed that the ratio of VBA and VBB is set to be smaller than the ratio of VAA and VAB.

As described above, when the rotation speed of the drum motor 61 is set to the first speed or the third speed according to the normal conveying speed, if the driving current value falls within the first range, the processor 811 continues to set the first speed or the third speed. If the driving current value is outside the first range, that is, if the driving current value falls within the second range which is a range of the driving current value larger than the upper limit value of the first range, the processor 811 sets the second speed lower than the first speed or the fourth speed lower than the third speed as the rotation speed. Thus, the computer using the processor 811 as a central portion functions as a setting unit that performs such settings by the processor 811 executing information processing based on the information processing program.

In ACT 21, the processor 811 performs image formation on one sheet of print paper PP. The processor 811 performs the image formation by the electrophotographic method in a well-known manner by allowing each unit of the printer 102 to perform well-known operations for the image formation. Then, the processor 811 proceeds to ACT 22 when the image formation is completed. The formation controller 82, the exposure controller 83, the inversion controller 86, and the motor controller 87 control each unit to be controlled to perform various operations at timings according to the changed conveying speed notified in advance from the processor 811.

In ACT 22, the processor 811 checks whether the job being executed is completed. The processor 811 determines that the job is completed, for example, when the formation of all the images targeted by the job being executed is completed. However, if the completion of the job cannot be checked as such, the processor 811 determines NO and proceeds to ACT 23.

In ACT 23, the processor 811 checks whether the predetermined reduction period ends. The reduction period may be appropriately defined by, for example, the designer of the MFP 100 based on an experiment, a simulation, an empirical rule, or the like as a period in which heat dissipation due to deceleration as described above is expected to progress to a certain extent. The reduction period is defined as, for example, a period during which a specified number of sheets of image are formed. Alternatively, the reduction period is defined as a period from when the conveying speed is reduced in ACT 20 to when the elapsed time reaches a predetermined time. Then, if the reduction period is not checked to be ended, the processor 811 determines NO and repeats ACT 21 and subsequent processes. Thus, the processor 811 continues to perform image formation in a decelerated state until the job is completed or the reduction period ends. Then, when the reduction period ends, the processor 811 determines YES in ACT 23 and proceeds to ACT 24.

In ACT 24, the processor 811 changes the conveying speed of the print paper PP. The processor 811 sets the conveying speed by, for example, the same process as ACT 12. That is, the processor 811 returns to the conveying speed during the normal time. Then, the processor 811 repeats ACT 16 and subsequent processes in the same manner as described above.

Now, when the processor 811 is in the loop of ACT 16 to ACT 19 or the loop of ACT 21 to ACT 23, if the formation of the last image targeted by the job is completed in ACT 16 or ACT 21, the job is determined to be completed as YES in ACT 17 or ACT 22, and the processor 811 proceeds to ACT 25.

In ACT 25, the processor 811 stops the rotation of the drum motor 61. For example, the processor 811 instructs the motor controller 87 to stop the drum motor 61. In response to the instruction, the motor controller 87 stops the drum motor 61. Here, the processor 811 may also stop motors other than the drum motor 61 included in the motor group 6.

In ACT 26, the processor 811 checks whether the gear 247-2 is in the meshed state. Then, if the gear 247-2 is in the meshed state, the processor 811 determines YES and proceeds to ACT 27.

In ACT 27, the processor 811 changes the gear 247-2 to the separated state. For example, the processor 811 operates the switch motor 62, and the moving mechanism 27 moves the gear 247-2 to the position in the separated state indicated by the one-dot dashed line in FIG. 3. Then, for example, the processor 811 stops the switch motor 62 in response to the detection that the gear 247-2 is at the position in the separated state by the sensor included in the sensor group 7 and, after that, ends the control process.

If the gear 247-2 is not checked to be in the meshed state, the processor 811 determines NO in ACT 26, by-passes ACT 27, and ends the control process. Thus, in standby state in which image formation is not performed, the gear 247-2 is in the separated state.

Figure 9:
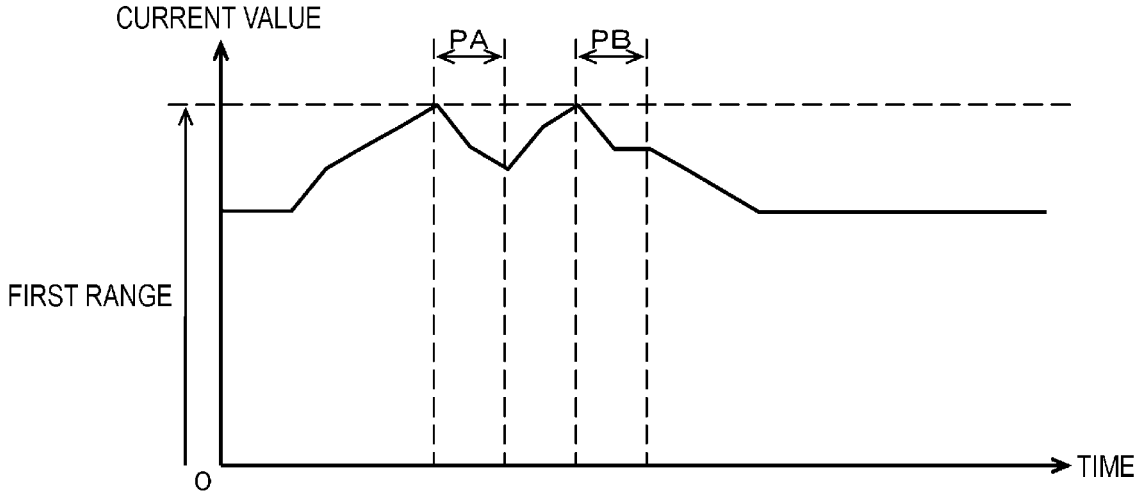
FIG. 9 is a diagram illustrating an example of a change in a driving current value of a drum motor.

FIG. 9 is a diagram illustrating an example of a change in the driving current value of the drum motor 61.

Periods PA and PB in FIG. 9 are periods during which the conveying speed is reduced.

In the example illustrated in FIG. 9, after the end of the period PA, the driving current value rises again by returning the conveying speed to the normal speed. Then, after the end of the period PB, even if the conveying speed is returned to the normal speed, the driving current value does not increase, and thus, the conveyance at the normal speed is continued.

According to the MFP 100 as described above, in a situation where the load of the drum motor 61 is excessive, the rotation speed of the drum motor 61 is reduced, and thus, the risk of the image quality being deteriorated as the stability of the rotation of the drum motor 61 decreases, or the risk of the drum motor 61 being broken can be reduced.

According to the MFP 100, when the reduction period ends, the rotation speed of the drum motor 61 is returned to the normal speed, and thus, the decrease in time efficiency of the image formation is reduced to a small extent.

After the control process related to one job is completed as such, the processor 811 newly starts the control process illustrated in FIG. 8 for the new job when the execution of the new job is commanded. Thus, the processor 811 sets the rotation speed of the drum motor 61 to a normal speed as the first speed after a series of image formation based on one command is completed. Therefore, according to the MFP 100, even if the previous job is completed in the state where the rotation speed of the drum motor 61 is reduced, the image formation can be started by using the rotation speed of the drum motor 61 as the normal speed for the new job.

The MFP 100 switches the normal speed between the first speed and the second speed. In the MFP 100, the third speed is a speed when the speed is reduced from the first speed, and the fourth speed is a speed when the speed is reduced from the second speed. Therefore, even during the reduction time, the speed can be set to an appropriate speed according to the paper type of the print paper PP used for the image formation.

When the normal speed is set to the second speed lower than the first speed, the MFP 100 has a smaller rate of decrease in speed due to reduction than when the normal speed is set to the first speed. Therefore, the decrease in time efficiency of the image formation during the speed reduction time when the normal speed is set to the second speed can be reduced to a small extent.

The MFP 100 switches the normal speed between the first speed and the second speed according to the paper type of the print paper PP used for the image formation. Therefore, it is particularly useful to switch the speed at a low speed between the third speed and the fourth speed as described above.

The MFP 100 uses the drum motor 61 to rotate one photoconductor drum 241 provided in the image forming unit 24-1 during the formation of a monochrome image, whereas the MFP 100 uses the drum motor 61 to rotate the four photoconductor drums 241 provided in the image forming units 24-1 to 24-4 during the formation of a color image. Therefore, the influence of the load fluctuation on the drum motor 61 is large, and thus, it is particularly useful to reduce the speed.

The MFP 100 sets a driving current value range equal to or lower than the rated current value of the drum motor 61 as the first range and sets a driving current value range higher than the rated current value as the second range. Therefore, the state in which the driving current value of the drum motor 61 is larger than the rated current value is not continued for a long period of time.

The embodiment can be performed in various modified ways as follows.

When the motor is likely to be overloaded due to fluctuation of the load, the control as in the above-described embodiment can be applied to various motors in addition to the drum motor.

The processor 811 continues to monitor the end of the reduction period even after the control process of FIG. 8 is completed, and when the control process of FIG. 8 is newly started before the reduction period ends, the processor 811 may set the reduced speed in ACT 12.

The determination of the paper type can be performed in various manners, for example, by the processor 811 based on the output of the sensor for measuring the physical quantities or physical properties such as the thickness of the print paper.

An image forming apparatus method other than the electrophotographic method may be used.

In the standby state in which the image formation is not performed, the gear 247-2 may be in the meshed state or may remain in the state of the gear 247-2 at the end time point of the previous job.

A portion or all of functions realized by the processor 811 by information processing in each of the embodiments described above can also be realized by hardware that executes information processing that is not based on a program such as a logic circuit or the like. Each of the above-mentioned functions can be realized by combining software control with the above-mentioned hardware such as a logic circuit.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a motor having a driving current value that changes according to a load;

an image forming component configured to form an image on a medium by using a rotation body rotated by the motor;

a measuring component configured to measure the driving current value of the motor; and a setting component configured to set a rotation speed of the motor to a first speed before executing a print command, to continuously set a first speed if the driving current value measured by the measuring component falls within a first range while the image forming component by the print command is forming a series of image formations, and to set a second speed lower than the first speed as the rotation speed if the driving current value measured by the measuring component falls within a second range higher than the first range while the image forming component by the print command is forming the series of image formations, to check whether or not a predetermined reduction period ends after setting the rotation speed to the second speed, and to return the rotation speed to the first speed when the predetermined reduction period ends.

2. The image forming apparatus according to claim 1, wherein the predetermined reduction period is defined as a period during which a specified number of sheets of image are formed by the image forming component.

3. The image forming apparatus according to claim 1, wherein the setting component sets the rotation speed to the first speed after a series of image formations by the image forming component after one command is completed.

4. The image forming apparatus according to claim 1, wherein when the rotation speed of the motor is set to a third speed, if the driving current value measured by the measuring component falls within the first range, the setting component continues to set the third speed, and if the driving current value measured by the measuring component falls within the second range, the setting component sets a fourth speed lower than the third speed as the rotation speed of the motor.

5. The image forming apparatus according to claim 4, wherein the setting component sets the third speed to a speed lower than the first speed and sets the fourth speed to a speed in which a ratio of the third speed to the fourth speed is smaller than a ratio of the first speed to the second speed.

6. The image forming apparatus according to claim 4, further comprising:

a determining component that determines a type of the medium, wherein the setting component sets the first speed or the third speed as the rotation speed according to a determination result by the determining component.

7. The image forming apparatus according to claim 1, wherein the image forming component includes a plurality of photoconductor drums and operates in any one of a plurality of operating states in which a number of the photoconductor drums rotated by the motor is different.

8. The image forming apparatus according to claim 1, wherein the setting component sets a driving current value range equal to or lower than a rated current value of the motor as the first range and sets a driving current value range higher than the rated current value as the second range.

9. A method for an image forming apparatus, comprising:

forming an image on a medium by using a rotation body rotated by a motor having a driving current value that changes according to a load;

measuring the driving current value of the motor;

setting a rotation speed of the motor to a first speed before executing a print command;

continuously setting a first speed if the driving current value measured falls within a first range while the print command is forming a series of image formations;

setting a second speed lower than the first speed as the rotation speed if the driving current value measured falls within a second range higher than the first range while the print command is forming the series of image formations;

checking whether or not a predetermined reduction period ends after setting the rotation speed to the second speed; and returning the rotation speed to the first speed when the predetermined reduction period ends.

10. The method according to claim 9, wherein the predetermined reduction period is defined as a period during which a specified number of sheets of image are formed.

11. The method according to claim 9, further comprising:

setting the rotation speed to the first speed after a series of image formations after one command is completed.

12. The method according to claim 9, further comprising:

when the rotation speed of the motor is set to a third speed, if the driving current value measured falls within the first range, continuously setting the third speed, and if the driving current value measured falls within the second range, setting a fourth speed lower than the third speed as the rotation speed of the motor.

13. The method according to claim 12, further comprising:

setting the third speed to a speed lower than the first speed and sets the fourth speed to a speed in which a ratio of the third speed to the fourth speed is smaller than a ratio of the first speed to the second speed.

14. The method according to claim 12, further comprising:

determining a type of the medium; and setting the first speed or the third speed as the rotation speed according to a determination result.

15. The method according to claim 9, further comprising:

setting a driving current value range equal to or lower than a rated current value of the motor as the first range and sets a driving current value range higher than the rated current value as the second range.

16. An image forming apparatus, comprising:

a motor having a driving current value that changes according to a load;

a photoconductive drum configured to form an image on a medium by being rotated by the motor;

a measuring component configured to measure the driving current value of the motor; and a setting component configured to set a rotation speed of the motor to a first speed before executing a print command, to continuously set a first speed if the driving current value measured by the measuring component falls within a first range while the photoconductive drum by the print command is forming the series of image formations, and to set a second speed lower than the first speed as the rotation speed if the driving current value measured by the measuring component falls within a second range higher than the first range while the photoconductive drum by the print command is forming a series of image formations, to check whether or not a predetermined reduction period ends after setting the rotation speed to the second speed, and to return the rotation speed to the first speed when the predetermined reduction period ends.

17. The image forming apparatus according to claim 16, wherein the predetermined reduction period is defined as a period during which a specified number of sheets of image are formed by the photoconductive drum.

* * * * *